US008558860B2

(12) United States Patent
Kubo

(10) Patent No.: US 8,558,860 B2
(45) Date of Patent: Oct. 15, 2013

(54) IMAGE FORMING APPARATUS

(75) Inventor: Isao Kubo, Tokoname (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 125 days.

(21) Appl. No.: 13/070,302

(22) Filed: Mar. 23, 2011

(65) Prior Publication Data

US 2011/0242259 A1 Oct. 6, 2011

(30) Foreign Application Priority Data

Mar. 31, 2010 (JP) ..... 2010-081770

(51) Int. Cl.
*B41J 2/47* (2006.01)
*B41J 2/435* (2006.01)

(52) U.S. Cl.
USPC ..... 347/247; 347/237

(58) Field of Classification Search
None
See application file for complete search history.

(56) References Cited

U.S. PATENT DOCUMENTS

| | | | | |
|---|---|---|---|---|
| 6,204,868 | B1 * | 3/2001 | Yamauchi et al. | 347/129 |
| 6,429,424 | B1 * | 8/2002 | Park | 250/236 |
| 2003/0235450 | A1 | 12/2003 | Okamoto et al. | |
| 2004/0207717 | A1 * | 10/2004 | Han et al. | 347/261 |
| 2005/0280378 | A1 | 12/2005 | Suzuki | |
| 2006/0127112 | A1 * | 6/2006 | Ono | 399/38 |
| 2007/0217853 | A1 * | 9/2007 | Kuwabara | 400/624 |
| 2008/0100243 | A1 * | 5/2008 | Kurosawa et al. | 318/430 |
| 2010/0245521 | A1 | 9/2010 | Kubo | |

FOREIGN PATENT DOCUMENTS

| | | | |
|---|---|---|---|
| JP | H10-225079 | A | 8/1998 |
| JP | H11-015332 | A | 1/1999 |
| JP | H11-034390 | A | 2/1999 |
| JP | H11-129538 | A | 5/1999 |
| JP | 2001-069779 | A | 3/2001 |
| JP | 2001-282052 | A | 10/2001 |
| JP | 2001-305470 | A | 10/2001 |
| JP | 2003-341925 | A | 12/2003 |
| JP | 2004-138840 | A | 5/2004 |
| JP | 2005-231105 | A | 9/2005 |
| JP | 2006-003755 | A | 1/2006 |
| JP | 2006-154250 | A | 6/2006 |
| JP | 2006-284833 | A | 10/2006 |
| JP | 2009-075512 | A | 4/2009 |
| JP | 2009-131081 | A | 6/2009 |

OTHER PUBLICATIONS

Japan Patent Office, Notification of Reasons for Refusal for Japanese Patent Application No. 2010-081770, dispatched Feb. 7, 2012.

* cited by examiner

*Primary Examiner* — Matthew Luu
*Assistant Examiner* — Kendrick Liu
(74) *Attorney, Agent, or Firm* — Baker Botts L.L.P.

(57) ABSTRACT

An image forming apparatus includes: a light source; a brushless motor including a stator and a rotor; a rotary polygon mirror rotated by the brushless motor to form scanning lines on a photosensitive member; an energization switching unit turning on/off energizations of the coils; a voltage detecting unit outputting a detection signal based on induced voltages generated in coils of the stator by rotation of the rotor; a motor controlling unit turning on/off of the energizations by the energization switching unit based on the detection signal; an electric component that operates during formation of the scanning lines; and a power supply controlling unit which, in a detecting period of the detection signal for starting a rotation control of the brushless motor, reduces an amount of electric power supplied to the electric component to less than in a period of the formation of scanning lines after the detecting period.

15 Claims, 10 Drawing Sheets

FIG. 8

| | FREQUENCY OF FORCED COMMUNICATION [Hz] | LEAD ANGLE [°] | CURRENT LIMIT | |
|---|---|---|---|---|
| | | | WHEN ROTOR INITIAL POSITION IS DETECTED [A] | IN FORCED COMMUTATION [A] |
| PATTERN 1 (INITIAL VALUE) | 30 | 20 | 1.8 | 1.6 |
| PATTERN 2 | 30 | 20 | 2.0 | 2.0 |
| PATTERN 3 | 30 | 15 | 2.0 | 2.0 |
| PATTERN 4 | 60 | 15 | 2.0 | 2.0 |

IMAGE FORMING APPARATUS

CROSS-REFERENCE TO RELATED APPLICATIONS

This application claims priority from Japanese Patent Application No. 2010-081770 filed on Mar. 31, 2010, the entire subject matter of which is incorporated herein by reference.

TECHNICAL FIELD

The present invention relates to an image forming apparatus, and more particularly to a brushless motor for rotating a rotary polygon mirror.

BACKGROUND

Some image forming apparatuses that form an image electrophotographically include an optical scanning mechanism having a rotary polygon mirror which deflects a light beam emitted from a light source to illuminate a photosensitive member. A brushless motor is sometimes used as a driving motor for rotating the rotary polygon mirror. In a brushless motor, it is necessary to detect a position of a rotor to control energization timing for each coil. There has been proposed a known image forming apparatus, in which a plurality of Hall elements are placed in a vicinity of the rotor, and the position of the rotor is detected based on output signals of Hall elements.

In the known image forming apparatus, because of placement dispersion of the Hall elements with respect to the rotor, or the like, it is difficult to detect the position of the rotor accurately. Thus, the rotation control on the brushless motor may be unstable.

SUMMARY

Illustrative aspects of the invention provide an image forming apparatus that can suppress in which a situation where the rotation control cannot be adequately started is suppressed.

BRIEF DESCRIPTION OF THE DRAWINGS

FIG. 8 is a view illustrating combination patterns of three parameters, i.e., the frequency of an energization on/off signal, the lead angle of the motor, and the current limit.

DETAILED DESCRIPTION

General Overview

Figure 1:
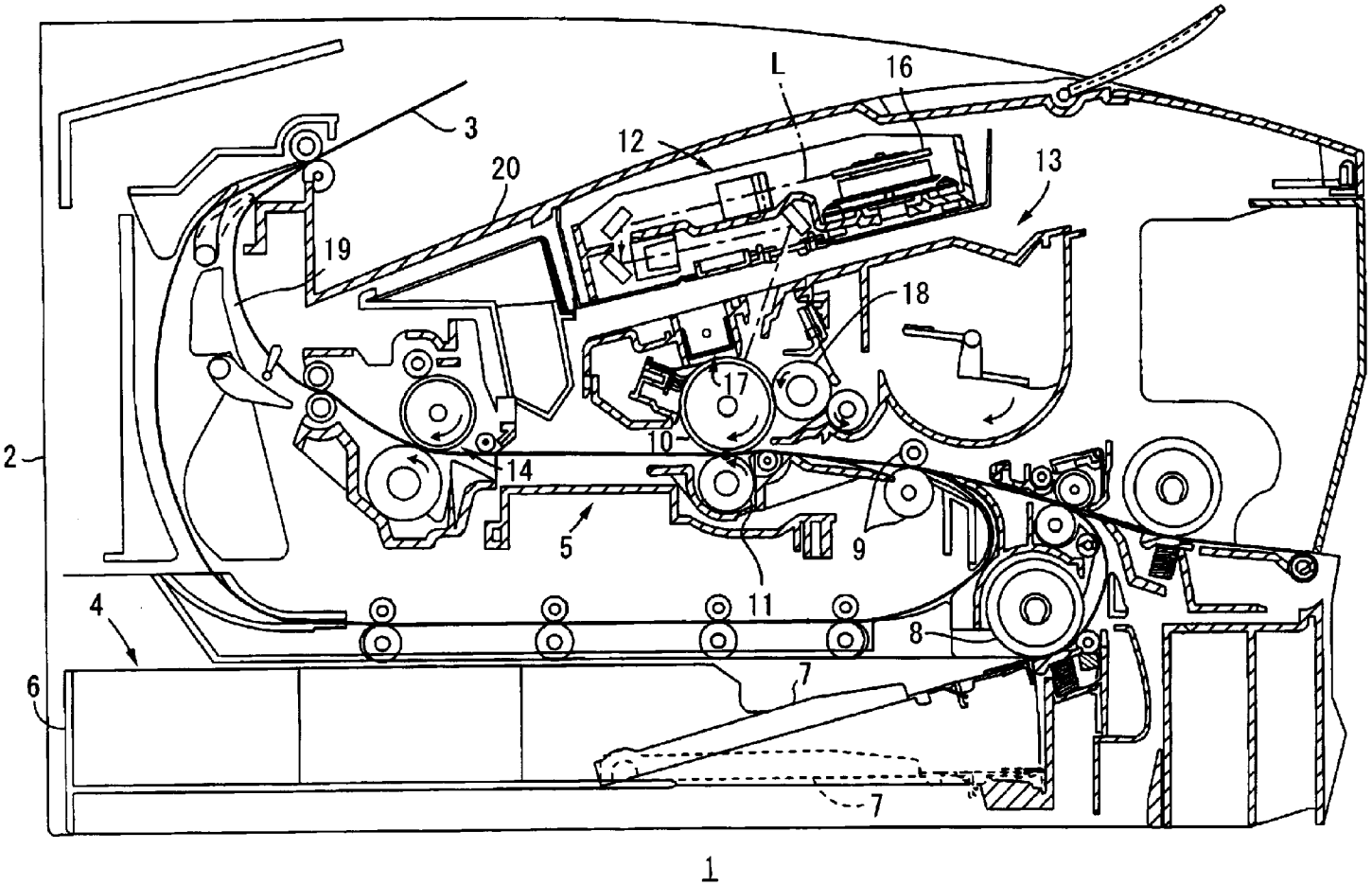
FIG. 1 is a schematic side sectional view of an image forming apparatus according to an exemplary embodiment of the invention.

The applicant of the present application has developed an image forming apparatus in which a rotation control on a brushless motor can be performed without using Hall elements. Specifically, the image forming apparatus includes: an energization switching unit which turns on and off energizations of coils of the brushless motor; a voltage detecting unit which outputs a detection signal based on induced voltages that are generated in the coils by rotation of the rotor; and a control unit which controls turning on/off of the energizations by the energization switching unit, based on the detection signal.

In the image forming apparatus which does not use Hall elements, in the case where the rotation control is started in the state where the brushless motor is stopped or at a low speed (hereinafter, such a state is referred to as "stopped state"), the detection signal cannot be detected. Therefore, the initial position of the rotor cannot be detected, and the rotation control cannot be performed by adequately energizing the coils. Consequently, the following countermeasure is taken. A pulse current is flown through each of the coils, and the initial position of the rotor is detected based on the detection signal which is changed depending on the position of the rotor. On the basis of a result of the detection of the initial position, energizations of the coils are sequentially turned on and off to forcibly perform energizations, so that it is attempted to rotate the rotor (this is referred to also as so-called "forced commutation").

However, in start of the rotation control, the brushless motor produces a small torque because of various reasons such as that driving of another electric component causes the brushless motor not to be supplied with a sufficient amount of electric power. Therefore, the detection signals fail to be accurately detected, and there is a problem in that the rotation control cannot be adequately started.

Therefore, illustrative aspects of the invention provide an image forming apparatus that can suppress a situation where the rotation control cannot be adequately started.

According to one illustrative aspect of the invention, there is provided an image forming apparatus comprising: a light source that emits a light beam; a photosensitive member; a brushless motor comprising: a stator in which a plurality of coils are placed; and a rotor in which a plurality of magnets are placed; a rotary polygon mirror, which is rotated by the brushless motor, and which periodically deflects the light beam emitted from the light source to form scanning lines on the photosensitive member; an energization switching unit that turns on and off energizations of the coils; a voltage detecting unit that outputs a detection signal based on induced voltages generated in the coils by rotation of the rotor; a motor controlling unit that controls the turning on/off of the energizations by the energization switching unit based on the detection signal; an electric component that operates during formation of the scanning lines; and a power supply controlling unit which, in a detecting period of the detection signal that is used by the motor controlling unit for starting a rotation control of the brushless motor, reduces an amount of electric power supplied to the electric component to less than an amount of electric power supplied to the electric component in a period of the formation of scanning lines after the detecting period.

According thereto, in the detecting period of the detection signals for starting the rotation control of the brushless motor, the amount of electric power supplied to the electric component is reduced as compared with during the subsequent formation of scanning lines (during the operation of the electric component). Therefore, as compared with a configuration where the amount of electric power supplied to the electric component is identical in both the detecting period and the formation of scanning lines, a large electric power can be supplied to the brushless motor in the detecting period, and the accuracy of detection of the detection signals can be improved. As a result, a situation where the rotation control cannot be adequately started can be suppressed.

According to another illustrative aspect of the invention, in the image forming apparatus, wherein in the detecting period, the motor controlling unit increases an upper limit of an amount of electric power supplied to each of the coils higher than in the period of the formation of scanning lines.

According thereto, in the detecting period, the upper limit of the amount of electric power supplied to each of the coils is increased higher than that during the formation of scanning lines. Therefore, as compared with a configuration where the upper limit of the amount of supplied electric power is identical in both the detecting period and the formation of scanning lines, a large electric power can be supplied to the brushless motor in the detecting period, and the accuracy of detection of the detection signals can be improved. As a result, a situation where the rotation control cannot be adequately started can be suppressed.

According to still another illustrative aspect of the invention, in the image forming apparatus, wherein the electric component is a driving motor for rotating the photosensitive member.

The driving motor for rotating the photosensitive member consumes a particularly large amount of electric power. When the amount of electric power supplied to the driving motor is further reduced than that in the formation of scanning lines as in the invention, that of electric power supplied to the brushless motor can be effectively ensured. Therefore, a situation where the rotation control cannot be adequately started can be suppressed more surely.

According to another illustrative aspect of the invention, there is provided an image forming apparatus comprising: a light source that emits a light beam; a photosensitive member; a brushless motor comprising: a stator in which a plurality of coils are placed; and a rotor in which a plurality of magnets are placed; a rotary polygon mirror, which is rotated by the brushless motor, and which periodically deflects the light beam emitted from the light source to form scanning lines on the photosensitive member; an energization switching unit that turns on and off energizations of the coils; a voltage detecting unit that outputs a detection signal based on induced voltages generated in the coils by rotation of the rotor; and a motor controlling unit that controls the turning on/off of the energizations by the energization switching unit based on the detection signal, wherein in a detecting period of the detection signal for starting a rotation control of the brushless motor, the motor controlling unit increases an upper limit of electric power supplied to each of the coils higher than in the period of the formation of scanning lines after the detecting period.

According thereto, in the detecting period, the upper limit of the amount of electric power supplied to each of the coils is increased higher than that during the formation of scanning lines. Therefore, as compared with a configuration where the upper limit of the amount of supplied electric power is identical in both the detecting period and the formation of scanning lines, a large electric power can be supplied to the brushless motor in the detecting period, and the accuracy of detection of the detection signals can be improved. As a result, a situation where the rotation control cannot be adequately started can be suppressed.

According to still another illustrative aspect of the invention, the image forming apparatus further comprises: an electric component that operates during formation of the scanning lines; and an error sensing unit that senses a rotation control error of the brushless motor, wherein when the error sensing unit senses the rotation control error, the detecting period of the detection signal that is used by the motor controlling unit for retrying the rotation control of the brushless motor is different from an operation preparing period elapsed until the electric component is started up to enter an operation state of the formation of scanning lines.

According thereto, when a rotation control error is sensed, the detecting period of the detection signals for retrying the rotation control of the brushless motor is different from the operation preparing period elapsed until the electric component is started up to enter the operation state of the formation of scanning lines. In the operation preparing period, a particularly large amount of electric power is supplied to the electric component. When the detection signals for retrying the rotation control of the brushless motor are detected while avoiding the operation preparing period, the accuracy of detection of the detection signals can be improved, and hence a situation where the rotation control cannot be adequately started can be suppressed.

According to still another illustrative aspect of the invention, in the image forming apparatus, wherein the detecting period of the detection signal for retrying is after the operation preparing period.

According thereto, the rotation control is retried after the electric component enters the operation state of the formation of scanning lines. Therefore, the formation of scanning lines can be started early after the rotation speed of the brushless motor is stabilized by the retry, and hence the delay of the start of image formation can be suppressed.

According to still another illustrative aspect of the invention, the image forming apparatus further comprises: an error sensing unit that senses a rotation control error of the brushless motor, wherein when the error sensing unit senses the rotation control error, the motor controlling unit increases or decreases at least one of a frequency of the on/off control, a lead angle and an upper limit of an amount of electric power supplied to each of the coils in the detecting period of the detection signal for retrying the rotation control of the brushless motor.

According thereto, when a rotation control error is sensed, in the detecting period of the detection signals for retrying the rotation control of the brushless motor, at least one of the frequency of the on/off control, the lead angle, and the upper limit of the amount of electric power supplied to each of the coils is increased or decreased. Preferably, the increase or decrease is performed in the direction along which the induced voltages are made higher than those in the previous detecting period. Therefore, as compared with a configuration where the frequency and the like are identical in both the previous detecting period and the detecting period in the retry, a larger electric power can be supplied to the brushless motor in the retry, and the accuracy of detection of the detection signals can be improved. As a result, a situation where the rotation control cannot be adequately started can be suppressed.

According to still another illustrative aspect of the invention, in the image forming apparatus, wherein when the error sensing unit senses the rotation control error even if the motor controlling unit retries all predetermined combination patterns including at least two of the frequency of the on/off control, the lead angle and the upper limit of the amount of electric power supplied to each of the coils, the motor controlling unit aborts the retry.

In the case where, although all predetermined combination patterns including at least two of the frequency of the on/off control, the lead angle, and the upper limit of the amount of electric power supplied to each of the coils are retried, a rotation control error is sensed, it is highly possible that, even when the retry is further continued, the rotation control error is not eliminated. Therefore, in the invention, the retry is aborted in such a case, and hence a situation where the retry is unnecessarily repeated can be suppressed.

According to still another illustrative aspect of the invention, the image forming apparatus further comprises: an error sensing unit that senses a rotation control error of the brushless motor; and a light source controlling unit that controls the light source to emit the light beam on a condition that the rotation control error is not sensed in the detecting period of the detection signal for starting the rotation control of the brushless motor.

According thereto, the light source is caused to emit light on condition that a rotation control error is not sensed in the detecting period of the detection signals for starting the rotation control of the brushless motor. Therefore, it is possible to suppress a situation where the light source irradiates the photosensitive member with the light while a rotation control error occurs and damages the photosensitive member.

According to the illustrative aspects of the invention, it is possible to suppress a situation where the rotation control cannot be adequately started.

Exemplary Embodiments

Exemplary embodiments of the invention will now be described with reference to the Drawings.

(1) Image Forming Apparatus

FIG. 1 is a schematic side sectional view of an image forming apparatus 1. Hereinafter, the right side of the sheet of the figure is assumed to be the front side of the image forming apparatus 1. The image forming apparatus 1 includes, in a body frame 2, a feeder unit 4 which feeds a sheet 3, an image forming unit 5 which forms an image on the fed sheet 3, etc. Incidentally, a laser printer is one example of the image forming apparatus 1.

The image forming apparatus 1 may be a monochrome laser printer or a color laser printer using two or more colors. For example, the image forming apparatus may be a multifunction device having a facsimile function, a copy function, a reading function (scanner function) and the like, as far as the device has an image forming (printing) function.

The feeder unit 4 includes a tray 6, a pressing plate 7, a pickup roller 8 and a pair of registration rollers 9, 9. The pressing plate 7 is swingable about a rear end portion to press the uppermost one of sheets 3 on the pressing plate 7 toward the pickup roller 8. The sheets 3 are picked up one at a time by rotation of the pickup roller 8.

Then, the sheet 3 is registered by the registration rollers 9, 9 and is fed to the transferring position. The transferring position is a position where a toner image on a photosensitive member 10 is transferred to the sheet 3, and where the photosensitive member 10 contacts a transferring roller 11.

The image forming unit 5 includes a scanner unit 12, a process cartridge 13 and a fixing unit 14. The scanner unit 12 includes a light source 15 (see FIG. 3), a polygon mirror 16 (one example of a rotary polygon mirror), etc. A laser beam L (one example of a light beam) emitted from the light source 15 illuminates the surface of the photosensitive member 10 while being periodically deflected by the polygon mirror 16. The scanner unit 12 will be described later in detail.

The process cartridge 13 includes the photosensitive member 10 (which is not limited to a drum type, but may be of a belt type), a scorotron-type charger 17, and a developing roller 18. The charger 17 uniformly charges the surface of the photosensitive member 10 to a positive polarity. The charged surface of the photosensitive member 10 is exposed to the laser beam L from the scanner unit 12 to form an electrostatic latent image. Then, toner carried on the surface of the developing roller 18 is supplied to the electrostatic latent image formed on the photosensitive member 10, and the image is developed.

The sheet 3, on which the toner image is formed, is fed to the fixing unit 14 where the toner image is thermally fixed to the sheet. Then, the sheet 3 is discharged onto a sheet discharge tray 20 through a discharge path 19.

(2) Electrical Configuration of Image Forming Apparatus

Figure 2:
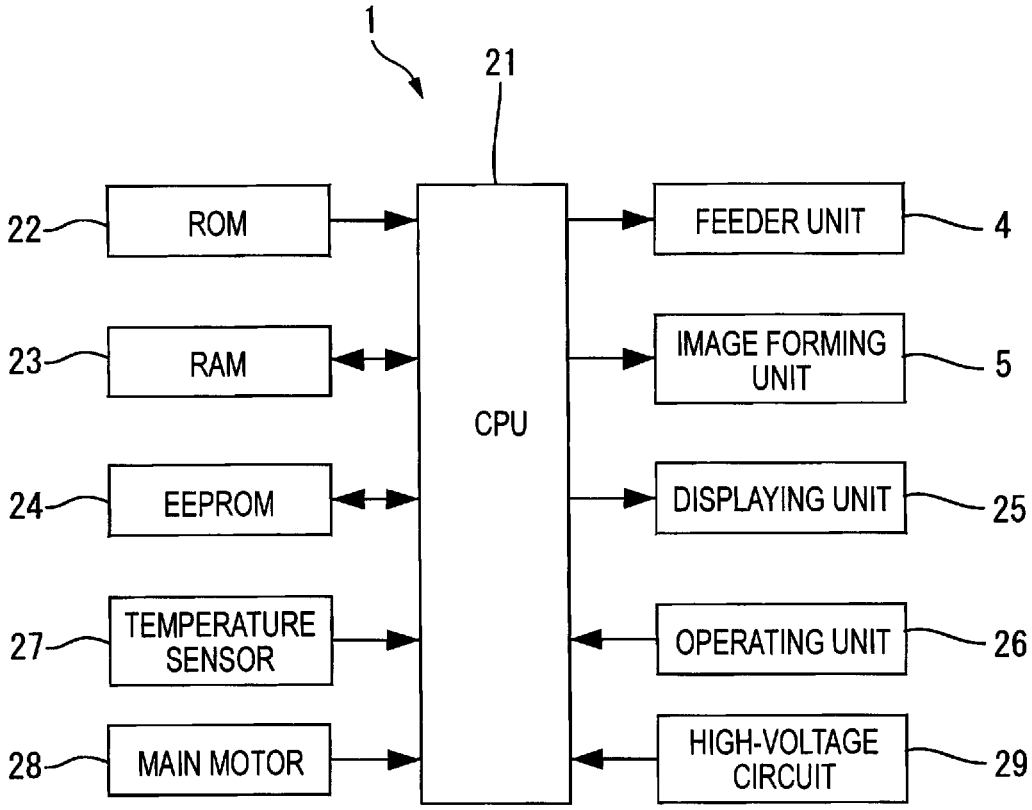
FIG. 2 is a block diagram exemplarily showing electrical configuration of the image forming apparatus.

As shown in FIG. 2, the image forming apparatus 1 includes a CPU 21 (one example of a power supply controlling unit), a ROM 22, a RAM 23, an EEPROM 24, the feeder unit 4, the image forming unit 5, a displaying unit 25, which is configured by various lamps, a liquid crystal panel, and the like, an operating unit 26 such as an input panel, a temperature sensor 27, etc. In addition, the image forming apparatus 1 includes a network interface (not shown) through which the image forming apparatus 1 is connected to an external apparatus, etc.

The main motor 28 (one example of a driving motor and an electric component) is a motor for rotating various transportation rollers 8, 9 of the above-described feeder unit 4, the photosensitive member 10, and the transferring roller 11, and different from a brushless motor 33 which is disposed in the scanner unit 12, and which will be described later. The high-voltage circuit 29 (one example of an electric component) is a circuit for applying a high voltage to each of the charger 17, the developing roller 18, and the transferring roller 11. The main motor 28 and the high-voltage circuit 29 are configured so as to be supplied with electric power from a power source which is common to the main motor 28, the high-voltage circuit 29 and the brushless motor 33.

(3) Scanner Unit

Figure 3:
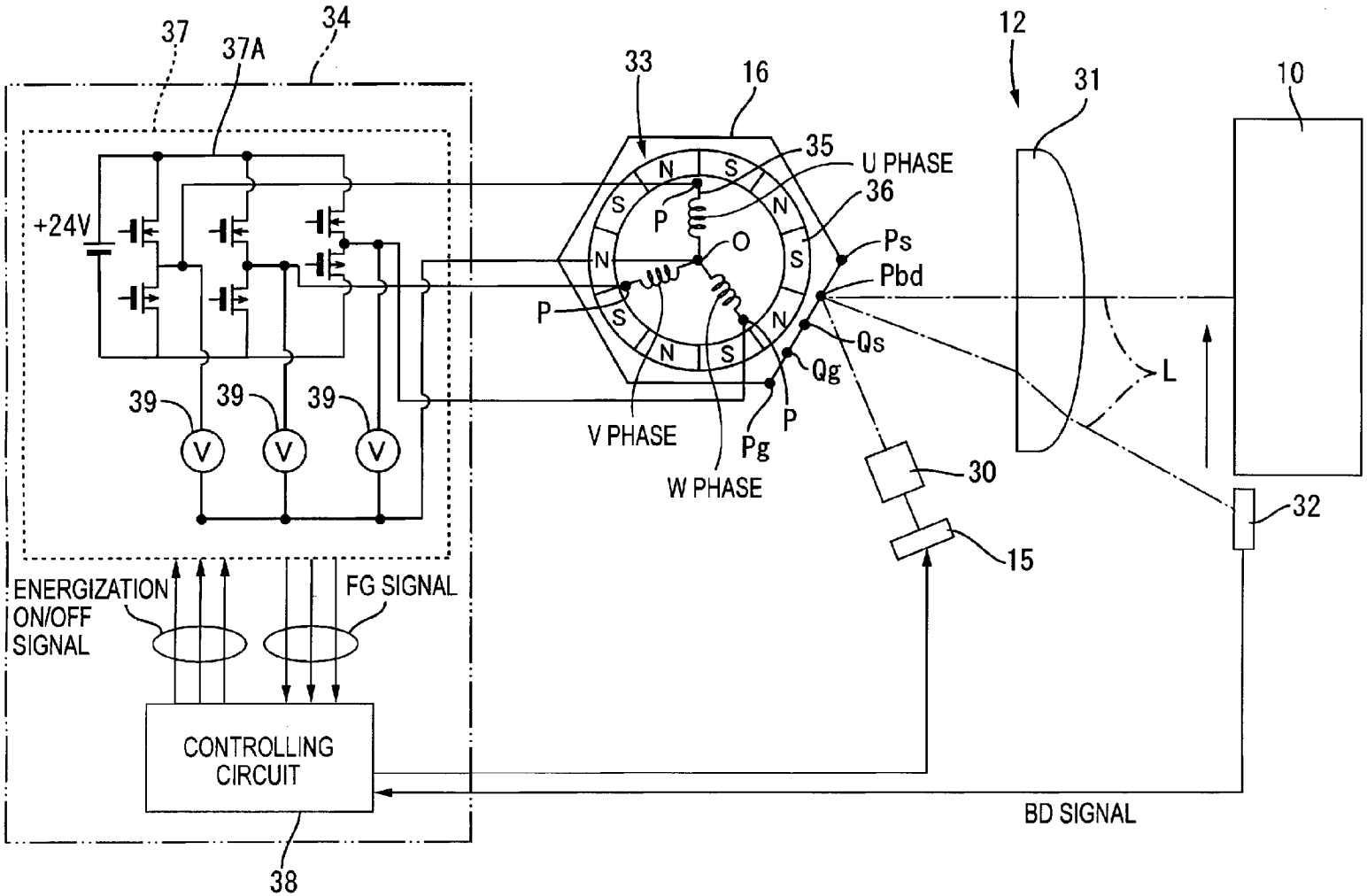
FIG. 3 is a diagram showing a configuration of a scanner unit.

As shown in FIG. 3, the scanner unit 12 includes the light source (i.e., a laser diode) 15 that emits the laser beam L, a first lens unit 30, the polygon mirror 16, a second lens unit 31, a light receiving sensor 32, a brushless motor (a polygon motor) 33, a control circuit board 34, etc.

The first lens unit 30 is configured by a collimator lens, a cylindrical lens, and the like. The first lens unit 30 allows the laser beam L emitted from the light source 15 to pass therethrough to irradiate the polygon mirror 16. The second lens unit 31 is configured by an fθ lens, a cylindrical lens, and the like. The second lens unit 31 allows the laser beam L deflected (reflected) by the polygon mirror 16 to pass therethrough to irradiate the photosensitive member 10.

The polygon mirror 16 is configured by, for example, a plurality of mirror surfaces (in the exemplary embodiment, six mirror surfaces). The polygon mirror 16 is rotated at a high speed by the brushless motor 33. When rotated at a high speed, the polygon mirror 16 periodically deflects the laser beam L emitted from the light source 15, to sequentially form scanning lines on the photosensitive member 10 through the second lens unit 31. The scanning lines are dot-like exposure lines corresponding to line data of image data. In the case where line data correspond to a blank portion of an image, scanning lines are not formed.

The brushless motor 33 is a three-phase brushless DC motor. The brushless motor 33 has a stator 35, on which U-, V- and W-phase coils are arranged, and a rotor 36, on which field permanent magnets (in the exemplary embodiment, for example, ten poles) are arranged. In the brushless motor 33, the coils are arranged in star connection. The polygon mirror 16 is rotated integrally with the rotor 36.

A driving circuit 37, a controlling circuit 38 (one example of a motor controlling unit, error sensing unit and a light source controlling unit), and the like, are mounted on the control circuit board 34. The driving circuit 37 rotates the brushless motor 33. The driving circuit 37 includes, for example, an inverter 37A (one example of an energization switching unit) to turn on or off the energizations of the coils. The controlling circuit 38 is configured by, for example, an ASIC. The controlling circuit 38 controls the light emission of the light source 15 and the rotation of the brushless motor 33 (the polygon mirror 16) based on instructions from the CPU 21.

The light receiving sensor 32 is placed at a position where the laser beam L is received before the laser beam L deflected by the polygon mirror 16 reaches the photosensitive member 10. The light receiving sensor 32 is used for determining a timing of writing each scanning line with the laser beam L, receives the laser beam L emitted from the light source 15, and outputs a BD (Beam Detect) signal to the controlling circuit 38. Alternatively, the light receiving sensor 32 may be placed at a position where the laser beam L is received after the laser beam L passes through the photosensitive member 10.

(4) Configuration for Detecting Position of Rotor

The controlling circuit 38 detects the position of the rotor 36 without using a position detecting element such as a Hall element. That is, the controlling circuit 38 detects the position of the rotor 36 on the basis of the induced voltages that are generated in the coils in accordance with rotation of the rotor 36 with respect to the stator 35.

When the rotor 36 rotates, S- and N-pole magnets alternately approach (magnetize) each of the coils, magnetic fluxes in the coil are correspondingly changed, and the induced voltage is generated in the coil. The impedance of each coil is different depending on the polarity of the approaching magnet, i.e., the S-pole or the N-pole. Therefore, the induced voltage has a waveform (for example, a sinusoidal wave) that is periodically changed to different levels respectively corresponding to timings of approaches of the S-pole and the N-pole. Therefore, by detecting the induced voltage, it is possible to detect the position of the rotor 36 (i.e., the polarity of the magnet approaching each coil).

The configuration for detecting the induced voltage will be described. As shown in FIG. 3, the driving circuit 37 includes three voltage detecting circuits 39, 39, 39 (one example of a voltage detecting unit) respectively corresponding to the coils. Each of the voltage detecting circuits 39 outputs a detection signal corresponding to the voltage difference (including the induced voltage) between the end point P of the corresponding coil (i.e., the end of the coil on the side connected to the driving circuit 37) and the neutral point O of the star connection. The driving circuit 37 converts each of the detection signals to a high/low signal (hereinafter, referred to as an FG signal), the level of which is inverted in accordance with a change of the induced voltage (i.e., the switching of the polarity of the magnet approaching the coil) through, for example, a comparator (not shown), and supplies the signal to the controlling circuit 38. Incidentally, the FG signal may also be called as a detection signal.

Figure 4:
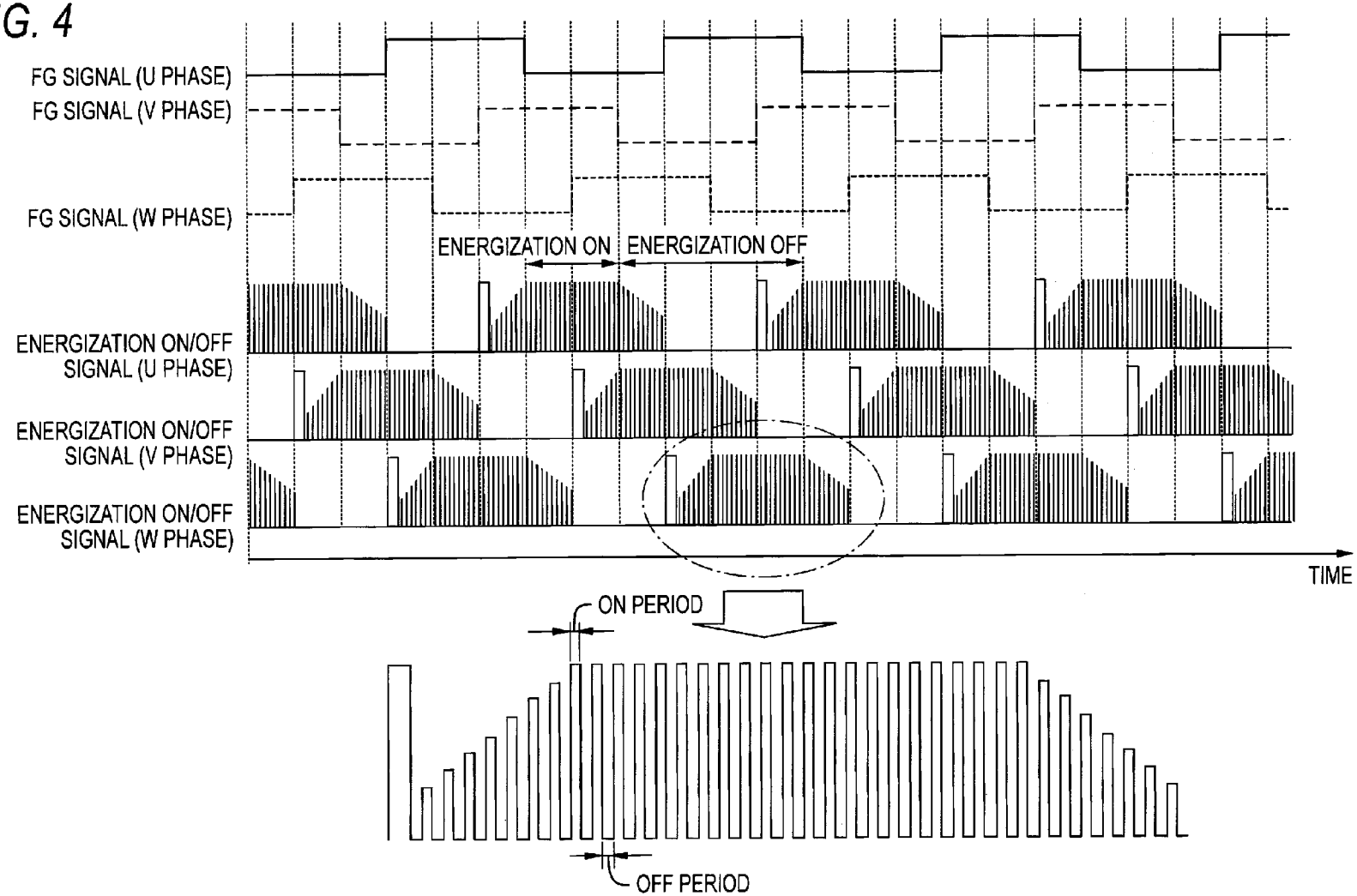
FIG. 4 is a time chart showing waveforms of FG signals and energization on/off signals.

FIG. 4 is a time chart showing waveforms of the FG signals and energization on/off signals. As shown in FIG. 4, the FG signals respectively corresponding to the phases are supplied to the controlling circuit 38 as waveforms in which the phases are shifted by about 120 deg. from one another. The controlling circuit 38 supplies the energization on/off signals respectively corresponding to the FG signals, to the driving circuit 37 to control the turning on/off of energizations of the coils. Therefore, the rotation of the brushless motor 33 can be controlled. In the energization on period, the portions where the amplitude of the PWM signal is gradually increased/decreased are energized when the coil of another phase is energized. The portion where the amplitude of the PWM signal is constant corresponds to a period where the coil of the own phase is energized. Each of the induced voltages is detected in the off period of chopping in the period where the amplitude of the PWM signal is gradually increased in the energization on period.

The controlling circuit 38 adjusts the current amount in the energization on time by, for example, the pulse width modulation, so that the rotation speed of the brushless motor 33 can be changed. As shown in FIG. 4, specifically, the controlling circuit 38 changes the PWM value (duty ratio) by performing chopping control on the inverter 37A during the energization on time on the basis of PWM signals, thereby changing the rotation speed of the brushless motor 33.

In the subsequent pulse group, the amplitude is stepwise raised, and then stepwise lowered. Therefore, in on/off switching of energization, noise generation can be suppressed.

As shown in FIG. 3, the control circuit board 34 is placed at a position separated from the place where the brushless motor 33 (the polygon mirror 16) is installed, and connected to the brushless motor 33 through only four signal lines, which are connected to the three end points P of the coil, and the neutral point O, respectively.

(5) Control of Rotation of Brushless Motor

Figure 5A:
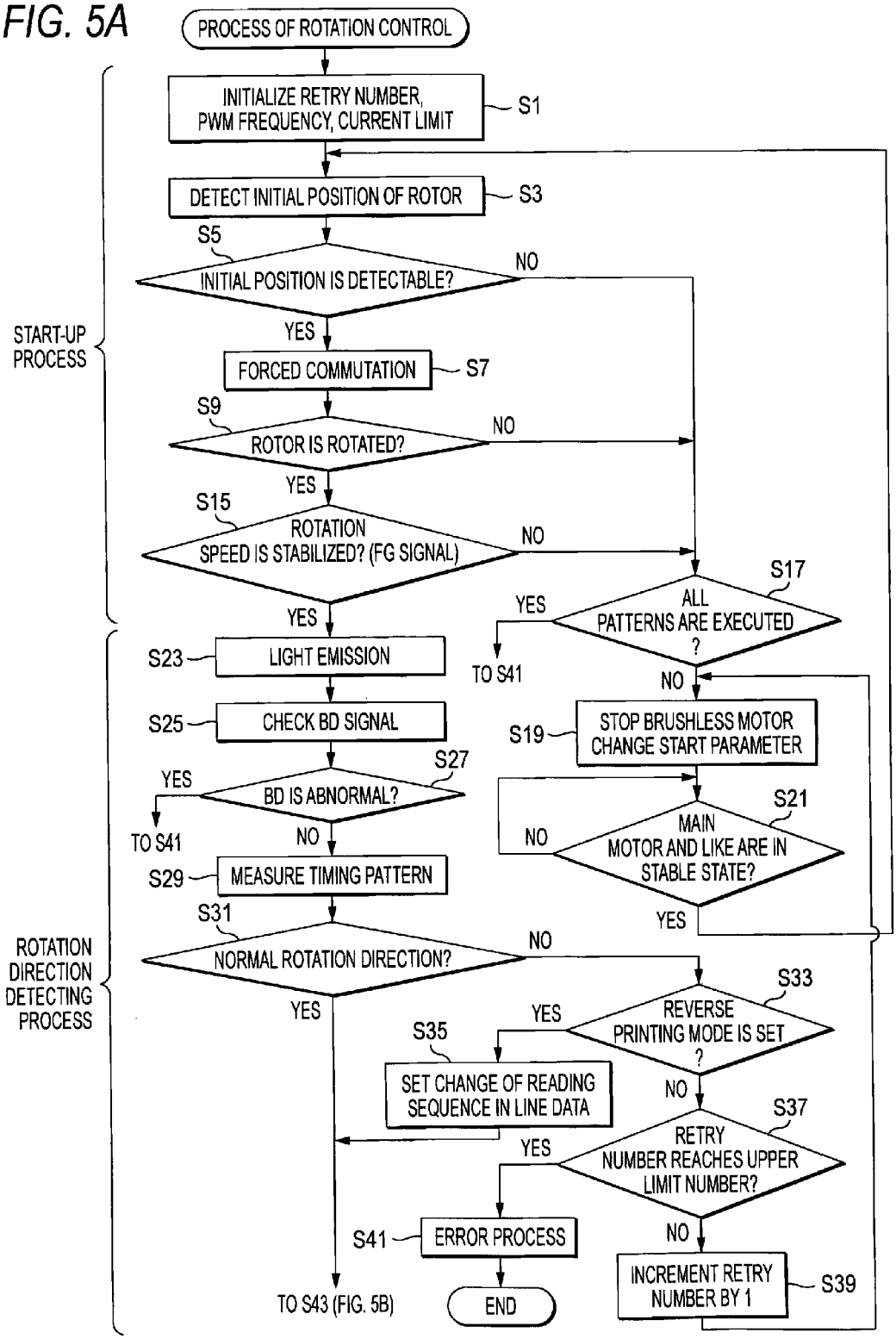
FIGS. 5A and 5B are flowcharts showing a rotation control process.
Figure 5B:
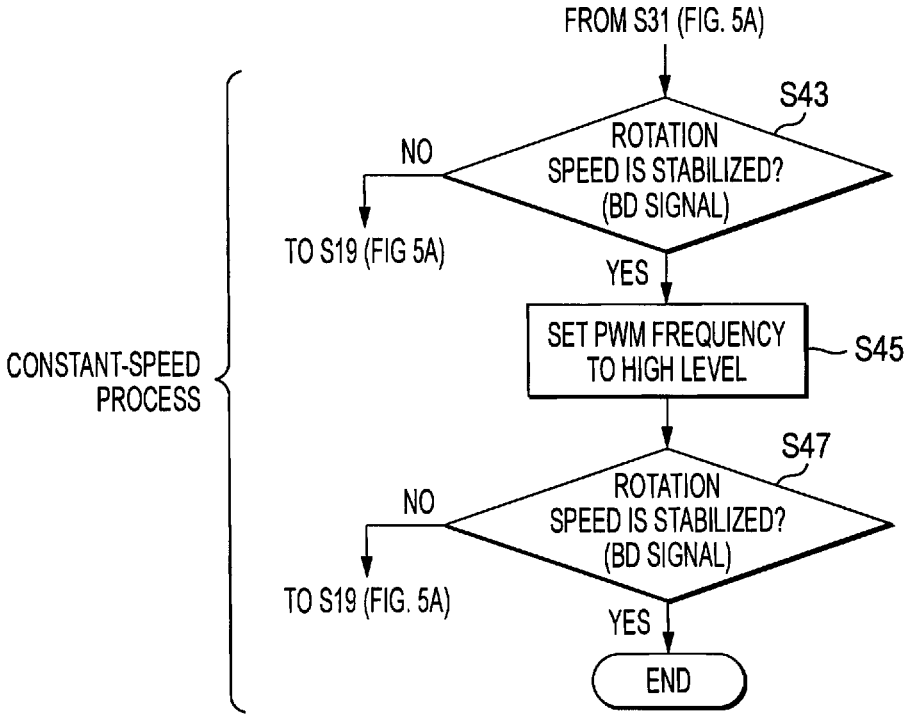
Figure 6:
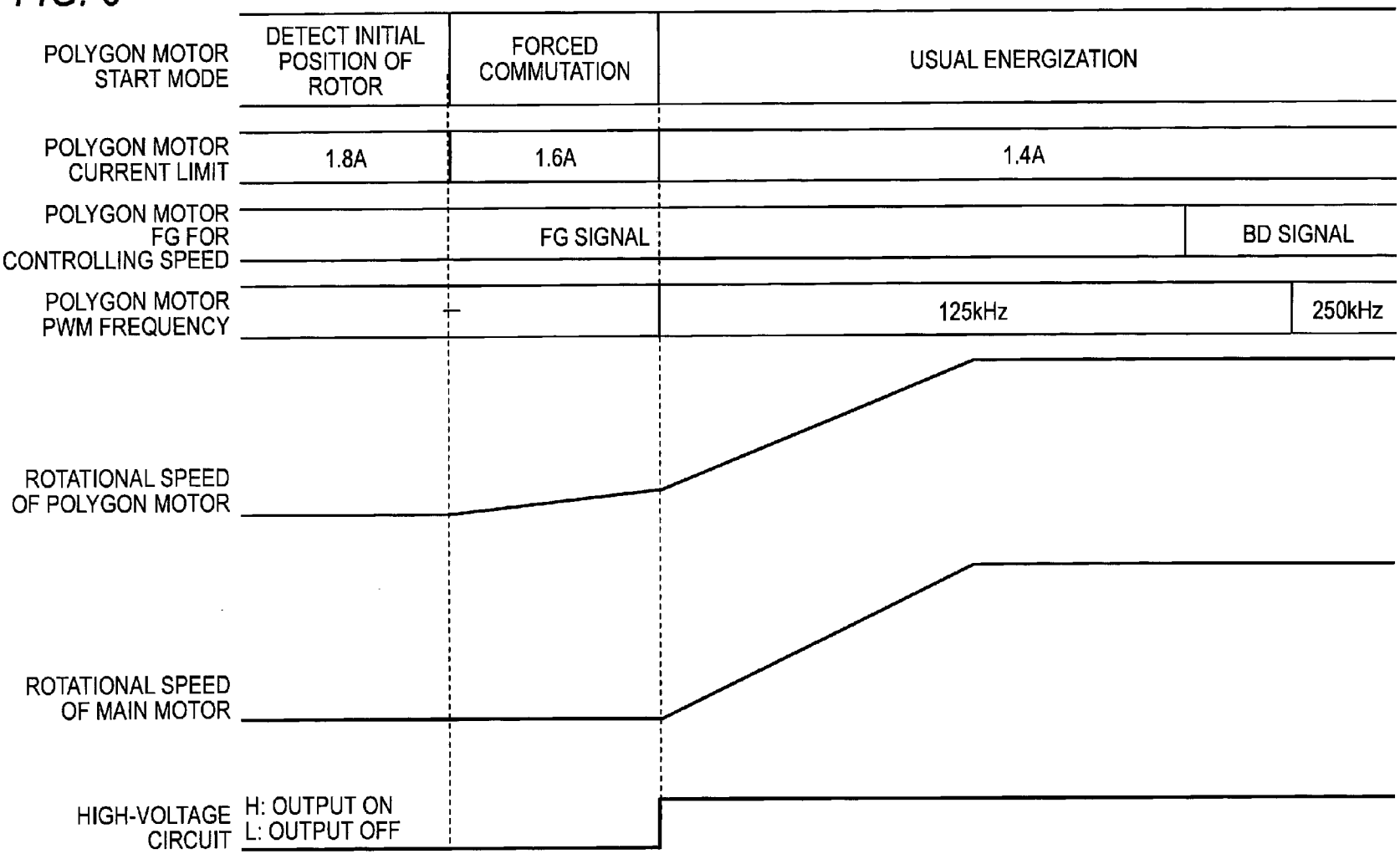
FIG. 6 is a time chart showing relationships of a control mode of a brushless motor, a set value of a current limit, operation states of motors, and the like (when the rotation control succeeds)
Figure 7:
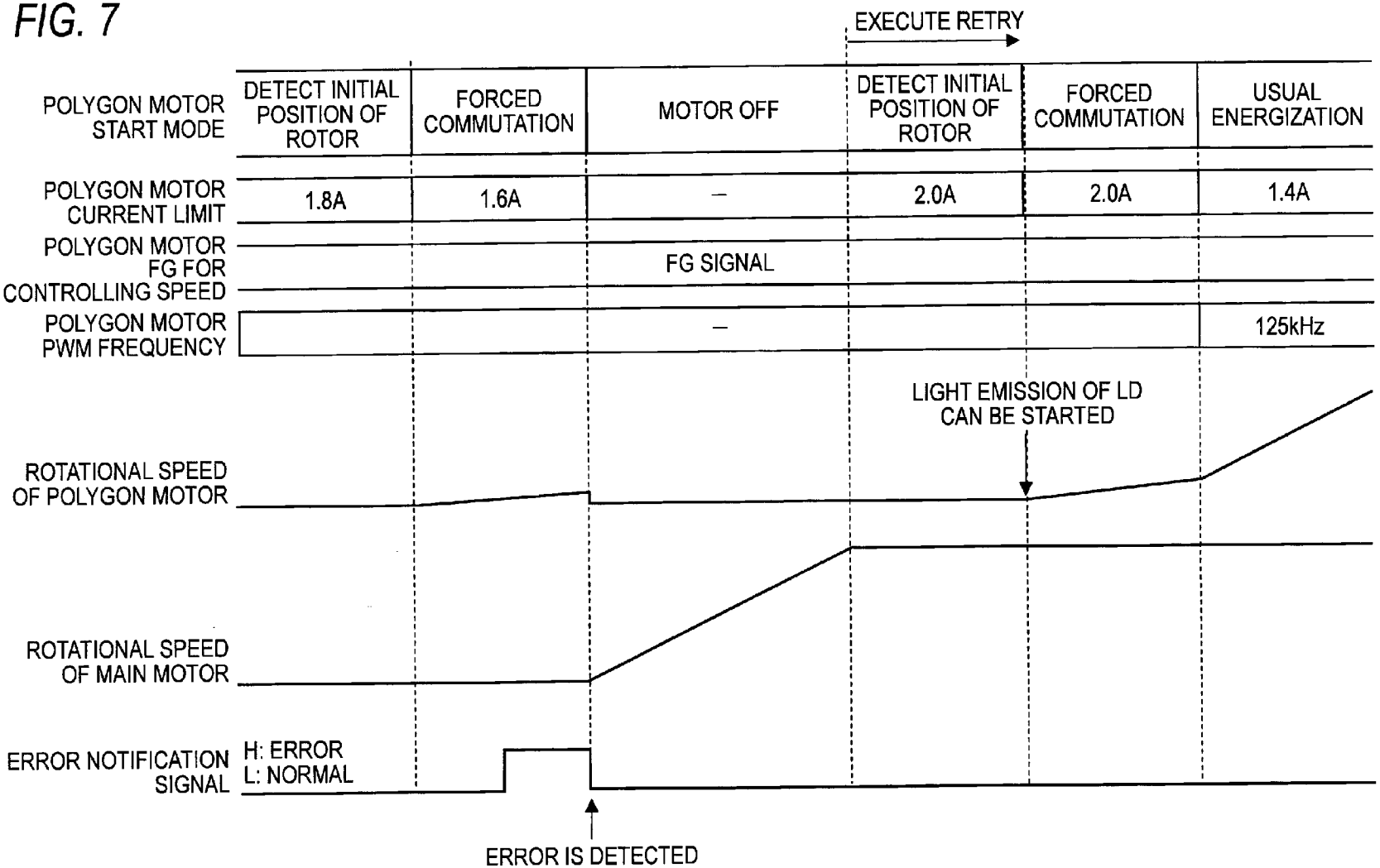
FIG. 7 is a time chart showing relationships of the control mode of the brushless motor, the set value of the current limit, operation states of the motors, and the like (when the rotation control fails)

FIG. 5 is a flowchart showing a process of controlling the rotation of the brushless motor 33, and FIGS. 6 and 7 are time charts showing relationships of a control mode of the brushless motor 33, a set value of a current limit, operation states of the motors, and the like. For example, the user performs an input operation for requesting the printing process through the operating unit 26, or an external apparatus (for example, a personal computer) which is not shown transmits a print request (which may include print data) to the image forming apparatus 1. Based on the print request, then, the CPU 21 transmits a rotation start instruction for the polygon mirror 16, to the controlling circuit 38. Upon receiving the rotation start instruction, the controlling circuit 38 executes the rotation control process shown in FIG. 5. In the rotation control process, a start-up process, a rotation direction detecting process, and a constant-speed process are sequentially executed.

(5-1) Start-Up Process

In the start-up process, first, the controlling circuit 38 initializes a retry number stored in, for example, the EEPROM 24 to zero, sets the PWM frequency to a low level (for example, 125 [kHz]), and sets the set value of the current limit to a first level (for example, 1.8 [A]) (S1).

The PWM frequency is the frequency of the pulses of the PWM signals, and equal to the frequency of the chopping control during the energization on time. The current limit (one example of "upper limit of the amount of supplied electric power") is the upper limit of the current which can be flown through each of the coils of the brushless motor 33. By the current limit, an overcurrent can be restricted from flowing through the brushless motor 33 during the rotation control. The first level is higher than a usual level (see FIGS. 6 and 7, for example, 1.4 [A]) during the printing process (formation of scanning lines) after the rotation control process is ended. In start-up (low speed) of the brushless motor 33, the torque of the brushless motor 33 is large. Thus, even when the current limit is set higher than that during the printing process (high speed), a possibility that an overcurrent flows is low.

Next, the controlling circuit 38 detects the initial position (the stop position before the start up) of the rotor 36 (S3). Specifically, the controlling circuit 38 controls the driving circuit 37 to flow pulse currents through the coils so that the magnetic fluxes in the coils are changed in accordance with the position of the rotor 36, and the coil voltages are changed in accordance with changes of the inductances of the coils. By detecting such coil voltages which are changed in accordance with changes of the inductances of the coils, the controlling circuit 38 detects the initial position of the rotor 36.

There is a case where, even when pulse currents are flown to the coils, the changes of the coil voltages are very small because of, for example, an insufficient torque of the brushless motor 33, and hence the controlling circuit 38 cannot detect the initial position of the rotor 36. Therefore, based on change levels of the coil voltages, for example, the controlling circuit 38 determines whether the initial position of the rotor 36 can be detected or not (S5). At this time, the controlling circuit 38 functions as an error sensing unit.

In the exemplary embodiment, in the period (one example of a detecting period) of executing the initial position detection by the rotor 36, as described above, the current limit is set to the first level which is higher than the usual level during the printing process. Therefore, as compared with a configuration where the current limit is set to the same value in both the period of executing the initial position detection and the printing process, a larger electric power can be supplied to the brushless motor 33 in the period of executing the initial position detection, and the accuracy of detection of the coil voltages can be improved. According thereto, a situation where the rotation control cannot be adequately started can be suppressed.

In the period of executing the initial position detection, the current supply (energization) to the main motor 28 and the high-voltage circuit 29 (hereinafter, generally referred to also as "main motor 28 and the like") is turned off by the CPU 21, and the main motor and the like are in a stopped state. In other words, in the period of executing the initial position detection, the amount of electric power supplied to the main motor 28 and the like is further reduced than that during the printing process. Therefore, as compared with the configuration where the amount of electric power supplied to the main motor 28 and the like is identical in both the period of executing the initial position detection and the printing process, a larger electric power can be supplied to the brushless motor 33 in the period of executing the initial position detection, and the accuracy of detection of the coil voltages can be improved. According thereto, a situation where the rotation control cannot be adequately started can be suppressed. At this time, the CPU 21 functions as a power supply controlling unit.

Moreover, the main motor 28 for rotating the photosensitive member 10 and the like consumes a particularly large amount of electric power. When the amount of electric power supplied to the main motor 28 in the period of executing the initial position detection is further reduced than that in the printing process as in the exemplary embodiment, that of electric power supplied to the brushless motor 33 can be effectively ensured. Therefore, a situation where the rotation control cannot be adequately started can be suppressed more surely.

However, even when the current limit is set to be high or the main motor 28 and the like are turned off, there may possibly be a case where the change levels of the coil voltages are smaller than a predetermined value and the initial position cannot be detected. In such a case where the initial position cannot be detected (one example of a rotation control error) (S5: NO), the control proceeds to S17. At this time, the controlling circuit 38 notifies the error occurrence to the CPU 21, and the CPU 21 turns on energizations of the main motor 28 and the like to start the driving control. As shown in FIG. 6, specifically, the CPU 21 increases the rotation speed of the main motor 28 toward a target speed (the speed in the printing process), and then performs a constant-speed control so as to maintain the target speed. The reason why, in the case where the rotation control error occurs, the rotation control is performed on the main motor 28 before the brushless motor 33 is restarted (retried) will be described later.

If the change levels of the coil voltages are equal to or larger than the predetermined value and the initial position can be detected (S5: YES), the controlling circuit 38 then executes forced commutation (forced energization) (S7). Also in the executing period (one example of a detecting period) of the forced commutation, the current limit is set to the first level (for example, 1.6 [A]) which is higher than the usual level. Furthermore, the main motor 28 and the like remain in the stopped state.

Specifically, on the basis of a result of the detection of the initial position, the controlling circuit 38 controls the driving circuit 37 so as to sequentially turn on and off energizations of the coils to forcibly perform energizations, so that it is attempted to rotate the rotor 36. If the rotor reaches to a rotation number at which the induced voltages can be detected (S9: YES), the induced voltages generated in the coils are reflected in the FG signals. Thus, based on the FG signals, the position and rotation speed of the rotor 36 can be detected. In contrast, in the case where the rotation of the rotor 36 cannot be checked (one example of a rotation control error) (S9: NO), the control proceeds to S17. At this time, in the same manner as the case of "NO" in S5, the controlling circuit 38 notifies the error occurrence to the CPU 21, and the CPU 21 turns on energizations of the main motor 28 and the like to start the driving control.

Moreover, the controlling circuit 38 reads out the induced voltages during the off period in the chopping control. Then, the controlling circuit 38 supplies the PWM signals of the low-level PWM frequency which is set in S1, to the driving circuit 37 to control the on/off of energizations of the coils, and executes the rotation speed control based on the FG signals, thereby attempting to perform full scale start-up of the brushless motor 33. The FG signals are produced from a part of signals which are detected from the induced voltages. The phase switch timing is determined based on the induced voltages (U, V, W), and the rotation speed control of the rotor 36 is performed by the FG signal produced from the induced voltage (U).

If the rotor reaches to a rotation number at which the induced voltages can be detected (S9: YES), the controlling circuit 38 determines whether the rotation speed of the brushless motor 33 is stabilized by the rotation speed control based on the FG signal or not (S15). Specifically, the rotation speed of the brushless motor 33 is detected on the basis of the on/off cycle of at least one (in the exemplary embodiment, one FG signal) of the three FG signals, and it is determined whether the detected rotation speed reaches a predetermined target speed range (for example, the difference with respect to 40,000 [rpm] is equal to or smaller than a predetermined value) or not.

If the detected rotation speed is outside the target speed range (one example of a rotation control error) (S15: NO), it is determined that the rotation speed is unstable. In the case where the initial position of the rotor 36 is erroneously detected in S3 above, for example, the brushless motor 33 is not normally rotated after the forced energization in S7, the rotation speed becomes unstable, and the start-up operation is sometimes failed. In this case, the control proceeds to S17. At this time, in the same manner as the case of "NO" in S5, the controlling circuit 38 notifies the error occurrence to the CPU 21, and the CPU 21 turns on energizations of the main motor 28 and the like to start the driving control.

When one of the rotation control errors occurs, the controlling circuit 38 determines whether all combination patterns of at least two of the start parameters (the frequency of the energization on/off signals (which is the frequency in the forced commutation, and which is different from the PWM frequency), the lead angle of the motor, the PWM values (motor currents), and the current limit) are executed or not, or whether the current retry number reaches the upper limit number or not (S17). FIG. 8 exemplarily shows combination patterns of three parameters, i.e., the frequency of the energization on/off signals, the lead angle of the motor, and the current limit. These combination patterns are configured by the three parameters, i.e., the frequency of the energization on/off control signal, the lead angle of the motor, and the current limit, and different from one another in at least one of the parameters. For example, the combination patterns are previously stored in the EEPROM 24. In the example of FIG. 8, the retry can be performed by patterns 2 to 4 excluding pattern 1 which is the initial value, and hence the upper limit of the retry number is three.

If all of the patterns are not executed (S17: NO), the retry number is incremented by one (S39), and the brushless motor 33 is stopped (S19). For example, reverse currents are caused to flow to apply a braking action on the brushless motor 33. Accordingly, the brushless motor 33 can be promptly stopped, and prepared for a retry operation.

Moreover, the controlling circuit 38 changes the pattern from the pattern which is currently set, to another one (S19). For example, the frequency of the energization on/off signals, the lead angle of the motor, and the current limit are increased, or the PWM values are enhanced to increase the starting current, thereby facilitating the start up of the brushless motor 33.

Then, the controlling circuit 38 determines based on information from the CPU 21 whether the main motor 28 is in the stable state where the rotation speed is stabilized in the target value or not (S21). On condition that the stable state is attained (S21: YES), the control returns to S3 to restart the brushless motor 33, or retry the detection of the initial position of the rotor 36. According to the configuration, the retry period (one example of "detecting period of the detection signals for retrying the rotation control of the brushless motor") is different from the period elapsed until the main motor 28 is in the stable state (one example of a operation preparing period) (see FIG. 7).

In the period elapsed until the main motor 28 is in the stable state, a particularly large amount of electric power is supplied to the brushless motor 33. When the FG signals for retrying the detection of the initial position of the rotor 36 (the rotation control of the brushless motor 33) are detected while avoiding the period, the accuracy of detection of the FG signals can be improved, and hence a situation where the rotation control cannot be adequately started can be suppressed. Moreover, the rotation control is performed on the main motor 28 before the retrying operation is performed on the brushless motor 33, and the stable state is attained. Therefore, the sheet 3 can be fed by the transportation rollers 8, 9 of the feeder unit 4 immediately after the rotation speed of the brushless motor 33 is stabilized by the retry of the brushless motor 33, and hence the delay of the start of the printing process can be suppressed.

If it is determined in S17 that all patterns are executed (S17: YES), as an error process (S41), the controlling circuit 38 stops the rotation control on the brushless motor 33, and displays information relating to the error on the displaying unit 25, thereby ending the rotation control process. Thereafter, the CPU 21 stops the rotation control of the main motor 28. In the case where all patterns are retried but a rotation control error is sensed, it is highly possible that, even when the retry is further continued, the rotation control error is not eliminated. Therefore, in such a case, the retry is aborted, and hence a situation where the retry is unnecessarily repeated can be suppressed. If it is determined in S15 that the detected rotation speed is within the target speed range (S15: YES), it is assumed that the rotation speed is stable, and the control is transferred to the rotation direction detecting process.

(5-2) Rotation Direction Detecting Process

The controlling circuit 38 executes the rotation direction detecting process to detect whether the rotor 36 rotates in a direction corresponding to the scanning direction (main scanning direction) with respect to the photosensitive member 10 or not. At this time, the controlling circuit 38 functions as "detecting unit". Hereinafter, a rotation direction corresponding to the main scanning direction (i.e., direction of the arrow in FIG. 3) is referred to as "normal rotation direction", and a rotation direction opposite to the normal rotation direction is referred to as "reverse rotation direction".

In the rotation direction detecting process, the controlling circuit 38 controls the light source 15 so as to start the light emission (S23). Therefore, the light receiving sensor 32 periodically receives the laser beam L deflected by the polygon mirror 16, and outputs the BD signal in accordance with the light receiving timing. On condition that the rotation speed of the brushless motor 33 is stabilized (S15: YES), the light source 15 is caused to emit a light beam. Therefore, a situation where, although a rotation control error occurs, the light from the light source 15 irradiates the photosensitive member 10 to damage it can be suppressed.

Next, the controlling circuit 38 checks the BD signal (S25). Specifically, it is determined whether the BD signal exists or not and whether the rotation speed of the polygon mirror 16 based on the period of the BD signal (hereinafter, the speed is sometimes referred to as the BD rotation speed) is within the target speed range or not. If it is determined that an abnormality occurs, for example, the BD signal is not sensed, or the BD rotation speed is unstable (S27: YES), an error process is performed (S41), and the rotation control process is ended. In contrast, if it is determined that the BD signal is normal (S27: NO), the control proceeds to S29.

Next, on the basis of the one FG signal and the BD signal that are received at this timing, the controlling circuit 38 measures the timing pattern of the detection of the induced voltage and the light reception of the light receiving sensor 32 (S29). The timing pattern is determined by the location relationship between the rotor 36 and the polygon mirror 16, and is different usually depending on the rotation direction.

Therefore, based on the timing pattern, the rotation direction of the rotor 36 can be detected.

Specifically, a predetermined number (one or more) of the time differences between the change timing (the rising timing or the falling timing) of the FG signal and the change timing (the rising timing or the falling timing) of the BD signal are calculated. The calculated time differences are set as the timing pattern.

Figure 9:
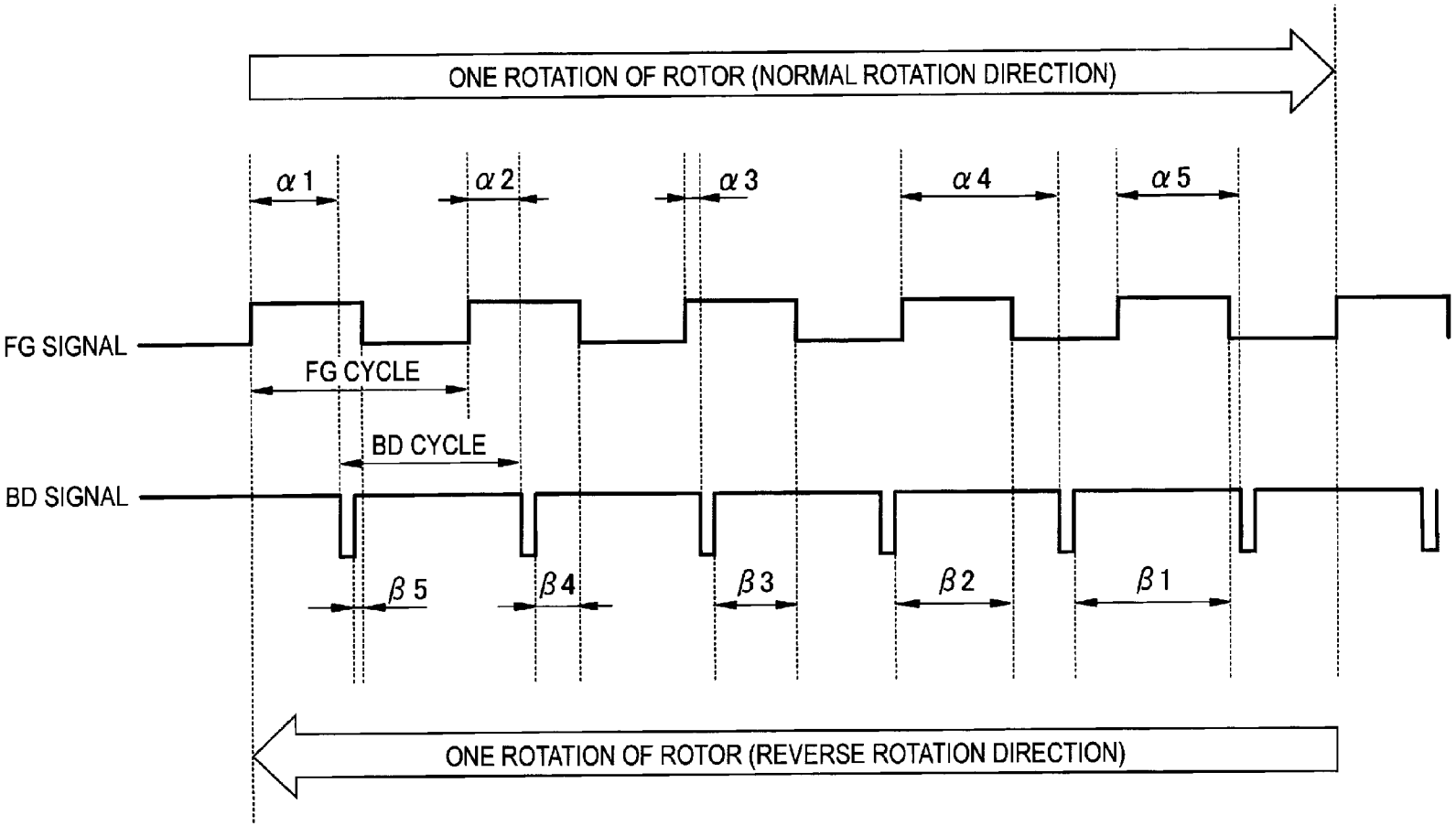
FIG. 9 is a time chart showing a timing pattern of detection of induced voltages and light reception of a light receiving sensor.

FIG. 9 is a time chart showing the timing pattern of detection of the induced voltages and light reception of the light receiving sensor 32. In the figure, α and β indicate a time differences from the rising timing of the FG signal and to the falling timing of the BD signal, respectively, wherein α (α1, α2, α3, α4 and α5) indicates a time difference in the case where the rotor 36 rotates in the normal rotation direction, and β (β1, β2, β3, β4 and β5) indicates a time difference in the case where the rotor 36 rotates in the reverse rotation direction.

As shown in FIG. 9, in the case where the rotor 36 rotates in the normal rotation direction, the controlling circuit 38 periodically calculates the time difference in the sequence of α1, α2, α3, α4 and α5. By contrast, in the case where the rotor 36 rotates in the reverse rotation direction, the controlling circuit 38 periodically calculates the time difference in the sequence of β1, β2, β3, β4 and β5.

On the other hand, for example, the EEPROM 24 previously stores reference pattern data. The reference pattern data include reference pattern data (α1, α2, α3, α4, α5) of the normal rotation direction and reference pattern data (β1, β2, β3, β4, β5) of the reverse rotation direction. Incidentally, the reference pattern data are prepared in production stage of the image forming apparatus 1 on the basis of a timing pattern that is experimentally measured in a state where the polygon mirror 16 is stably rotated within the target speed range.

The controlling circuit 38 compares the currently measured timing pattern with the reference pattern data (reference pattern), and, based on a result of the comparison, detects the rotation direction of the rotor 36 (S31). Specifically, when the measured timing pattern data coincide with the pattern data of the normal rotation direction, it is determined that the rotor rotates in the normal rotation direction, and, when the timing pattern data coincide with the pattern data of the reverse rotation direction, it is determined that the rotor rotates in the reverse rotation direction. If it is determined that the rotor rotates in the normal rotation direction (S31: YES), the control process is transferred (switches) to the constant-speed process.

If it is determined that the rotor rotates in the reverse rotation direction (S31: NO), it is determined whether a reverse printing mode is set or not (S33). In the reverse printing mode, even when the rotor 36 (the polygon mirror 16) is reversely rotated, an image in the same direction as the normal rotation is forcedly printed.

The reverse printing mode is set in such a case that the user inputs instructions through the operating unit 26, or that the temperature (ambient temperature) measured by the temperature sensor 27 disposed in the image forming apparatus 1 is equal to or lower than a predetermined temperature, because of the following reason. In the case where the ambient temperature is low to some extent, there is a possibility that the lubricant in the brushless motor 33 hardens and the rotation cannot be smoothly controlled. When a retrying process is performed under this situation, a long time period is required. This is not preferable.

If the reverse printing mode is set (S33: YES), the reading sequence in each line data of the image data is reversely set (S35), and the control process is transferred (switches) to the constant-speed process. Therefore, when the printing process is executed, the controlling circuit 38 controls the light emission of the light source 15 based on the line data in a pattern that is the reversal of that in the case where the polygon mirror 16 is rotated in the normal rotation direction. Even in the reverse rotation, an image, which is substantially identical with that in the normal rotation, can be forcedly printed. At this time, the controlling circuit 38 functions as "light emission controlling unit".

As shown in FIG. 3, in the case where the polygon mirror 16 is rotated in the normal direction (counterclockwise direction) and a latent image for one exposure line is formed on the photosensitive member 10, the starting point where one surface of the polygon mirror 16 is started to be illuminated with the laser beam L from the light source 15 is indicated by Ps, the point where the reflected light is received by the light receiving sensor 32 is indicated by Pbd, and the end point is indicated by Pg. In the one surface of the polygon mirror 16, the point illuminated with the laser beam L at the timing of starting the reading of line data is indicated by Qs, and the point illuminated with the laser beam L at the timing of ending the reading of line data is indicated by Qg. In the case where the polygon mirror 16 is rotated in the normal direction, the reading of line data is started after the time period required for the laser beam L to advance the length of the line segment PbdQs has elapsed from the light receiving timing of the light receiving sensor 32. By contrast, in the case where the polygon mirror 16 is rotated in the reverse direction, the reading of line data is started after the time period required for the laser beam L to advance the length of the line segment (PbdPs+PgQg) has elapsed from the light receiving timing of the light receiving sensor 32.

The controlling circuit 38 may be configured so that, in a process of expanding image data, a dot pattern, in which line data are expanded in the sequence reverse to that in the case of the normal rotation, is formed, and the light emission of the light source 15 is controlled in accordance with the dot pattern. Alternatively, the controlling circuit may be configured so that, when a dot pattern that has undergone a normal expanding process is to be read out, the reading is performed in the sequence reverse to that in the case of the normal rotation, and the light emission of the light source 15 is controlled in accordance with the dot pattern of the reverse sequence.

If it is determined in S33 the reverse printing mode is not set (S33: NO), it is determined whether the current retry number reaches the upper limit number or not (S37). If the current retry number does not reach the upper limit number (S37: NO), the retrying process is performed. Specifically, the retry number is incremented by one (S39), the control process is returned to S19, and the processes subsequent to S19 are repeated.

If the current retry number reaches the upper limit number (S37: YES), the error process is executed (S41), and the rotation control process is ended.

(5-3) Constant-Speed Process

In the constant-speed process, the controlling circuit 38 switches the rotation speed control from one based on the FG signals to one based on the BD signal, and determines whether the rotation speed of the polygon mirror 16 is stable or not (S43). Specifically, the rotation speed of the polygon mirror 16 is detected on the basis of the on/off cycle of the BD signal, and it is determined whether the detected rotation speed is within the predetermined target speed range or not. If the detected rotation speed is outside the target-speed range (S43: NO), it is determined that the rotation speed is unstable, and the control process is returned to S19.

If the detected rotation speed of the polygon mirror 16 is within the target-speed range (S43: YES), it is determined that the rotation speed is stable, and the PWM frequency is switched to a high level (for example, 250 [kHz]) (S45). Based on the BD signal, then, it is again determined whether the rotation speed is within the predetermined target speed range or not (S47). If the detected rotation speed is outside the target-speed range (S43: NO), it is determined that the rotation speed is unstable, and the control process is returned to S19. In contrast, if the detected rotation speed is within the target-speed range (S47: YES), it is determined that the rotation speed is stable, and the rotation control process is ended, thereby completing the preparation for the printing process. Thereafter, the CPU 21 causes the feeder unit 4 and the image forming unit 5 to start the printing process.

Modification to Exemplary Embodiments

The invention is not limited to the above-described exemplary embodiments. For example, the following various embodiments are within the scope of the invention. Among the components of the exemplary embodiments, specifically, those other than the most significant components of the invention are additional components and hence may be adequately omitted.

(1) In the above-described exemplary embodiments, The brushless motor is a three-phase outer-rotor type motor having star-connected coils. The invention is not limited thereto. For example, the phase number of the motor may be two, or four or more. An inner-rotor type motor may be employed, or a delta-connected motor may be used. In the case of the delta connection, on the base of the inter-terminal voltages of the coils, for example, a detection signal corresponding to the induced voltage can be obtained.

(2) In the above-described exemplary embodiments, the polygon mirror 16 having six mirror surfaces, and the brushless motor 33 having ten poles are used. However, the invention is not limited thereto. A brushless motor having mirror surfaces, the number of which is other than six, or a brushless motor having a pole number that is other than ten may be employed. The minimum required number of the time difference data $\alpha$, $\beta$ in the rotation direction detecting process can be obtained from the surface number (N) of the polygon mirror, and the pole number (M) of the brushless motor. That is, the minimum ratio (A:B) of the surface number (N) to a half (M/2) of the pole number (M) is calculated, the smaller value (A or B) in the minimum ratio is the minimum required number. Therefore, in the case where the surface number (N) is equal to a half (M/2) of the pole number, the rotation direction can be detected from one set of time difference data.

(3) In the above-described exemplary embodiments, the rotation speed of the brushless motor 33 is controlled by using the FG signals. However, the invention is not limited thereto. For example, a configuration may be employed where the number of rotations of the brushless motor 33 is monitored on the basis of the FG signals, and, under the conditions that the number of rotations reaches a reference number, various operations in the printing process such as that the light emission of the light source 15 is started, and that the sheet 3 is fed to the image forming unit 5 may be started. A configuration where timings of energizing the coils are controlled may be employed.

(4) In the above-described exemplary embodiments, in the stabilized period, the control process is transferred (switched) to the rotation speed control based on the BD signal. Alternatively, the rotation speed control based on the FG signals may be continued. Incidentally, in the stabilized period, influences due to noises are relatively reduced, and hence it is preferable to raise the frequency so that the follow-up property of the rotation control in the brushless motor 33 is enhanced.

(5) In the above-described exemplary embodiments, in the rotation control process, the PWM frequency is switched to a high level (S45) after it is confirmed that the rotation speed is stabilized based on the BD signal (S43 in FIG. 5B: YES). However, the invention is not limited thereto. After it is confirmed that the rotation speed is stabilized based on the FG signals (S15: YES), the PWM frequency may be switched to a high level. Incidentally, in terms of reliability, it may be preferable to switch the PWM frequency to a high level in accordance with the above-described exemplary embodiment.

(6) In the above-described exemplary embodiments, reverse currents are caused to flow to apply a braking action on the brushless motor 33. However, the braking method is not limited thereto. For example, a braking action may be applied on the brushless motor 33 by a mechanical (physical) contact with the rotor.

(7) In the above-described exemplary embodiments, the main motor 28 and the high-voltage circuit 29 are exemplified as one example of the electric component. However, the invention is not limited thereto. For example, the fixing unit 14, a cooling fan (not shown), and the like which have been operated (heated) in the formation of scanning lines by the scanner unit 12 may be used as "electric component". In summary, any component is included in "electric component" in the invention as far as it "operates during the formation of scanning lines".

(8) In the above-described exemplary embodiments, in the start-up process, the electric components such as the main motor 28 and the high-voltage circuit 29 are in the stopped state. The invention is not limited thereto. The electric components are requested to be operated at a power consumption which is lower than that in the formation of scanning lines.

(9) In the above-described exemplary embodiments, after the main motor 28 is started and its rotation speed is stabilized, the rotation control of the brushless motor 33 is retried. The invention is not limited thereto. A configuration where the rotation control of the main motor 28 is started after the rotation control of the brushless motor 33 is retried may be employed. In the configuration, the printing process can be started after it is surely confirmed that the rotation speed of the brushless motor 33 is stabilized.

What is claimed is:

1. An image forming apparatus comprising:

a light source configured to emit a light beam;

a photosensitive member;

a brushless motor comprising:

a stator in which a plurality of coils are placed; and a rotor in which a plurality of magnets are placed;

a rotary polygon mirror, which is configured to be rotated by the brushless motor, and which is configured to periodically deflect the light beam emitted from the light source to form scanning lines on the photosensitive member;

an energization switching unit configured to turn on and off energizations of the coils;

a voltage detecting unit configured to output a detection signal based on induced voltages generated in the coils by rotation of the rotor;

a motor controlling unit configured to control the turning on and off of the energizations by the energization switching unit based on the detection signal;

an electric component that operates during formation of the scanning lines;

an initial position detecting unit configured to detect an initial position of the rotor that is a stop position at which the rotor is stopped before the motor controlling unit starts a rotation control of the brushless motor; and a power supply controlling unit which, in a detecting period in which the initial position of the rotor is detected by the initial position detecting unit, is configured to reduce an amount of electric power supplied to the electric component to less than an amount of electric power supplied to the electric component in a period of the formation of scanning lines after the detecting period, wherein, in the detecting period, the motor controlling unit is configured to increase an upper limit of an amount of electric power supplied to each of the coils higher than in the period of the formation of scanning lines.

2. The image forming apparatus according to claim 1, wherein the electric component is a driving motor configured to rotate the photosensitive member.

3. The image forming apparatus according to claim 1, further comprising:

an error sensing unit configured to sense a rotation control error of the brushless motor, wherein when the error sensing unit senses the rotation control error, a detecting period in which the detection signal is detected is different from an operation preparing period elapsed until the electric component is started up to enter an operation state of the formation of scanning lines.

4. The image forming apparatus according to claim 3, wherein the detecting period in which the detection signal is detected is after the operation preparing period.

5. The image forming apparatus according to claim 1, further comprising:

an error sensing unit configured to sense a rotation control error of the brushless motor, wherein when the error sensing unit senses the rotation control error, the motor controlling unit is configured to increase or decrease at least one of a frequency of the on and off control, a lead angle, and an upper limit of an amount of electric power supplied to each of the coils in the detecting period in which the detection signal is detected.

6. The image forming apparatus according to claim 5, wherein when the error sensing unit senses the rotation control error, even when the motor controlling unit retries all predetermined combination patterns including at least two of the frequency of the on and off control, the lead angle, and the upper limit of the amount of electric power supplied to each of the coils, the motor controlling unit is configured to abort the retry.

7. The image forming apparatus according to claim 1, further comprising:

an error sensing unit configured to sense a rotation control error of the brushless motor; and a light source controlling unit configured to control the light source to emit the light beam when the rotation control error is not sensed in the detecting period in which the detection signal is detected.

8. The image forming apparatus according to claim 1, wherein the plurality of coils are connected via a star connection, and wherein the voltage detecting unit is connected to a neutral point of the star connection and an end point of each coil of the plurality of coils different from the neutral point and is configured to output a signal, which is based on a difference in potential between the neutral point of the star connection and the end point of each coil of the plurality of coils different from the neutral point, as the detection signal.

9. An image forming apparatus comprising:

a light source configured to emit a light beam;

a photosensitive member;

a brushless motor comprising:

a stator in which a plurality of coils are placed; and a rotor in which a plurality of magnets are placed;

a rotary polygon mirror, which is rotated by the brushless motor, and which is configured to periodically deflect the light beam emitted from the light source to form scanning lines on the photosensitive member;

an energization switching unit configured to turn on and off energizations of the coils;

a voltage detecting unit configured to output a detection signal based on induced voltages generated in the coils by rotation of the rotor;

a motor controlling unit configured to control the turning on and off of the energizations by the energization switching unit based on the detection signal; and an initial position detecting unit configured to detect an initial position of the rotor that is a stop position at which the rotor is stopped before the motor controlling unit starts a rotation control of the brushless motor, wherein in a detecting period in which the initial position of the rotor is detected by the initial position detecting unit, the motor controlling unit is configured to increase an upper limit of electric power supplied to each of the coils higher than in the period of the formation of scanning lines after the detecting period.

10. The image forming apparatus according to claim 9, further comprising:

an electric component configured to operate during formation of the scanning lines; and an error sensing unit configured to sense a rotation control error of the brushless motor, wherein when the error sensing unit senses the rotation control error, a detecting period in which the detection signal is detected is different from an operation preparing period elapsed until the electric component is started up to enter an operation state of the formation of scanning lines.

11. The image forming apparatus according to claim 10, wherein the detecting period in which the detection signal is detected is after the operation preparing period.

12. The image forming apparatus according to claim 9, further comprising:

an error sensing unit configured to sense a rotation control error of the brushless motor, wherein when the error sensing unit senses the rotation control error, the motor controlling unit increases or decreases at least one of a frequency of the on and off control, a lead angle, and an upper limit of an amount of electric power supplied to each of the coils in the detecting period o in which the detection signal is detected.

13. The image forming apparatus according to claim 12, wherein when the error sensing unit senses the rotation control error, even when the motor controlling unit retries all predetermined combination patterns including at least two of the frequency of the on and off control, the lead angle and the upper limit of the amount of electric power supplied to each of the coils, the motor controlling unit is configured to abort the retry.

14. The image forming apparatus according to claim 9, further comprising:

an error sensing unit configured to sense a rotation control error of the brushless motor; and a light source controlling unit configured to control the light source to emit the light beam when the rotation control error is not sensed in the detecting period in which the detection signal is detected.

15. The image forming apparatus according to claim 9, wherein the plurality of coils are connected via a star connection, and wherein the voltage detecting unit is connected to a neutral point of the star connection and an end point of each coil of the plurality of coils different from the neutral point and is configured to output a signal, which is based on a difference in potential between the neutral point of the star connection and the end point of each coil of the plurality of coils different from the neutral point, as the detection signal.

* * * * *